United States Patent [19]

Cicanese

[11] Patent Number: 4,685,837

[45] Date of Patent: Aug. 11, 1987

[54] PORTABLE SAFETY TRENCH AND PIT FORM SYSTEM

[76] Inventor: William C. Cicanese, Rte. 1, Box 845E, Punta Gorda, Fla. 33950

[21] Appl. No.: 871,788

[22] Filed: Jun. 9, 1986

[51] Int. Cl.[4] ..... E21D 5/00

[52] U.S. Cl. ..... 405/282; 405/272

[58] Field of Search ..... 405/272–274, 405/276, 281, 282, 283, 284, 285, 133, 149; 160/135, 351; 52/128, 135, 136, 139, 141, 142

[56] References Cited

U.S. PATENT DOCUMENTS

| | | | |
|---|---|---|---|
| 1,363,187 | 12/1920 | Miller | 160/135 X |
| 1,649,996 | 11/1927 | Toth | 160/135 X |
| 1,794,704 | 3/1931 | Miller | 405/282 |
| 2,145,152 | 1/1939 | Brown | 405/272 |
| 3,781,944 | 1/1974 | Gianardi | 160/135 X |
| 3,969,852 | 7/1976 | Krings | 405/282 X |
| 4,090,365 | 5/1978 | Nieber | 405/282 |
| 4,310,267 | 1/1982 | Davis | 405/283 |
| 4,530,622 | 7/1985 | Mercer | 405/284 X |

FOREIGN PATENT DOCUMENTS

| | | | |
|---|---|---|---|
| 650332 | 2/1951 | United Kingdom | 405/282 |
| 800279 | 1/1981 | U.S.S.R. | 405/272 |

*Primary Examiner*—Cornelius J. Husar
*Assistant Examiner*—Nancy J. Stodola
*Attorney, Agent, or Firm*—Charles J. Prescott

[57] ABSTRACT

A multi-sided portable trench and pit form system having at least two panels forming each side, each panel releasably interconnectable along the vertical margins of each adjacent panel and side. Elongated rigid braces are also provided which releasably interconnect to and against the sides and spanning the interconnected panels to rigidize the sides. Additionally, the elongated braces also interconnect at their ends to rigidize the preselected relative angular positioning of the sides one to another. The entire assembly forms a barrier or perimeter wall as required within which a user may safely function when working below ground level. An opening may be provided in one panel or between adjacent panels forming a side and having a slideable closure panel to provide working access outside of the enclosure. This modular system is adaptable to variation in the number of sides required, as well as variation in both side width and height.

8 Claims, 19 Drawing Figures

Fig. 1
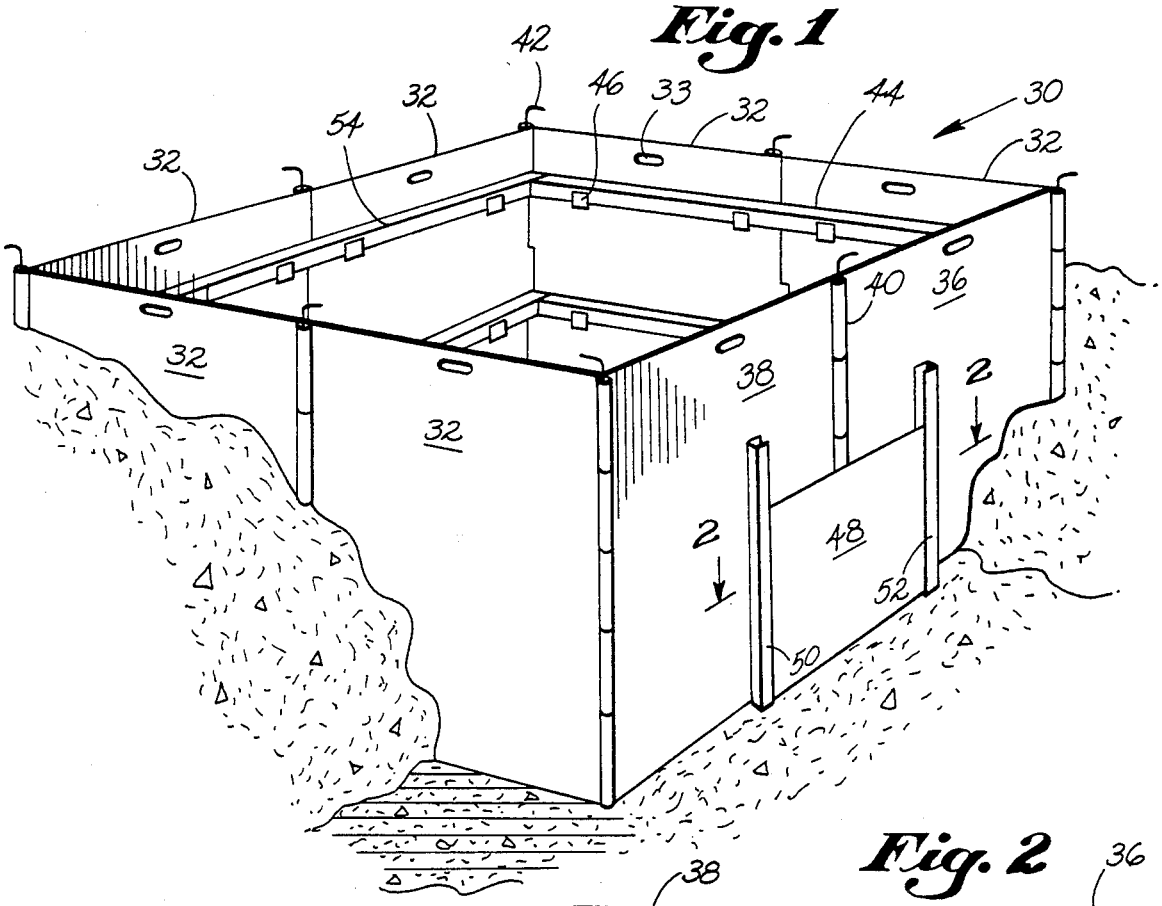
Fig. 2
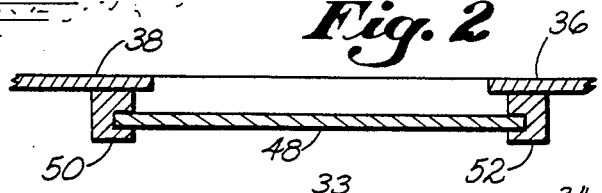
Fig. 3
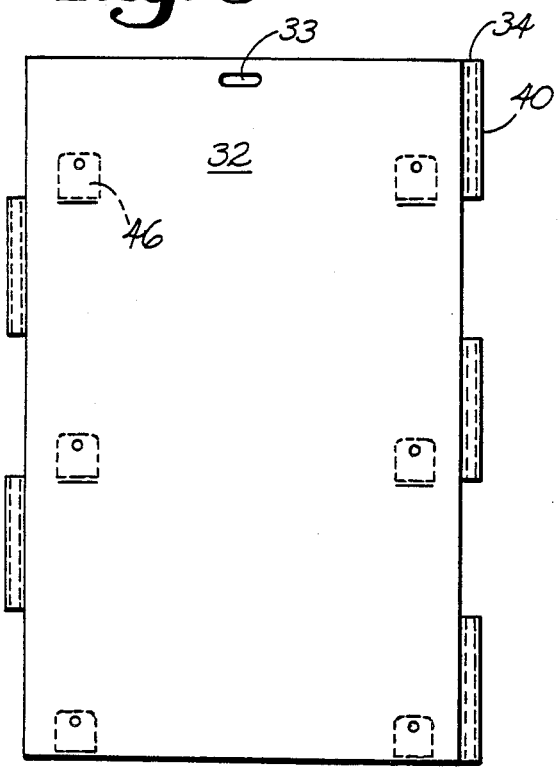
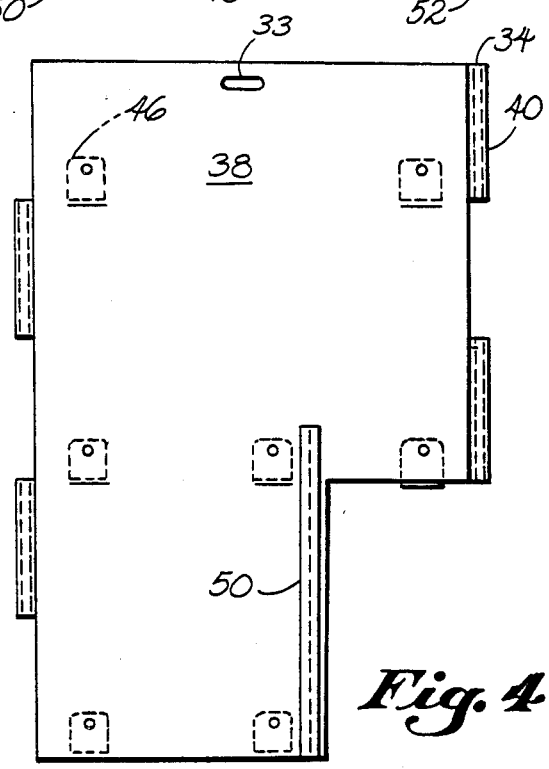
Fig. 4

Fig. 5
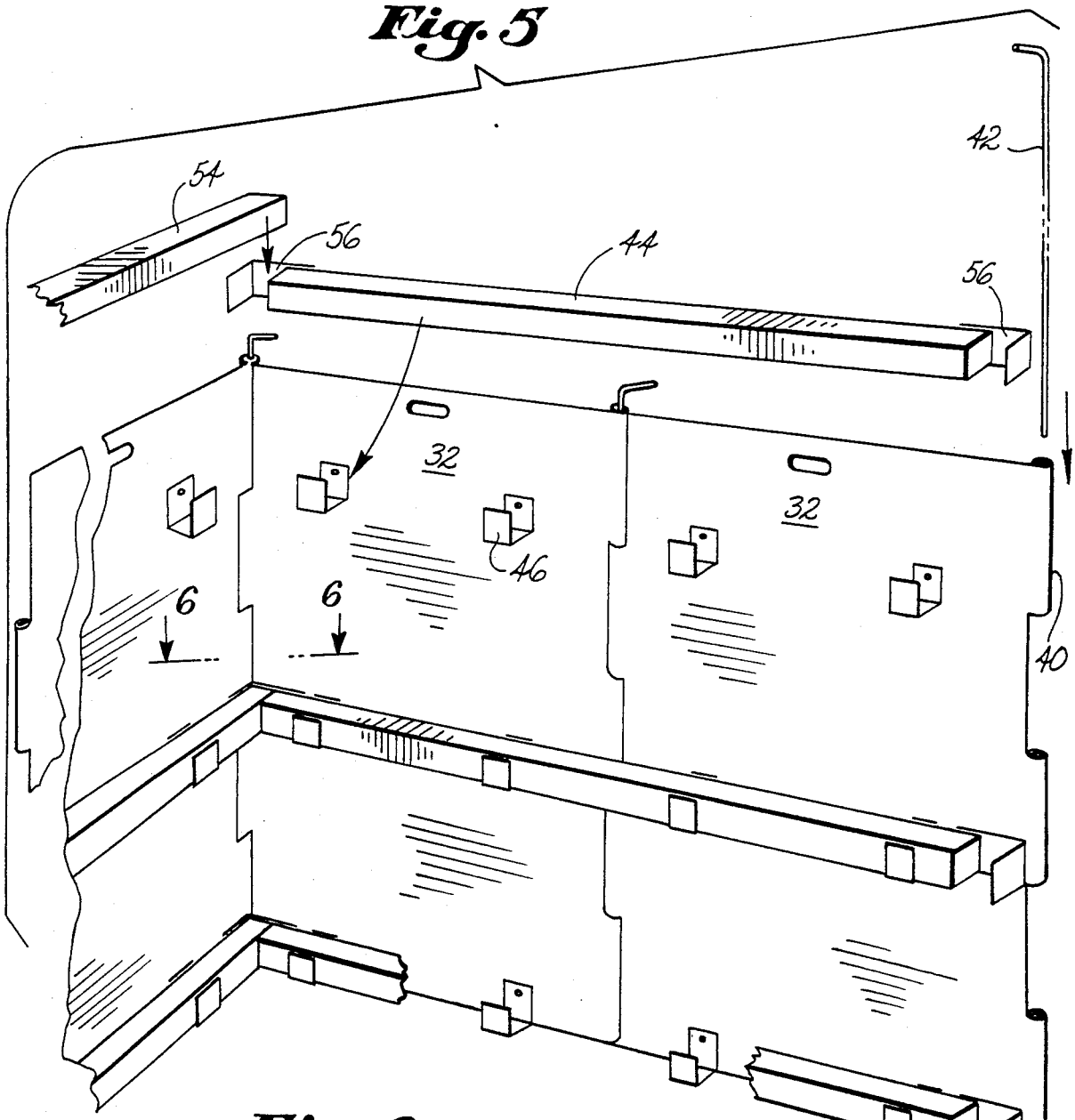
Fig. 6
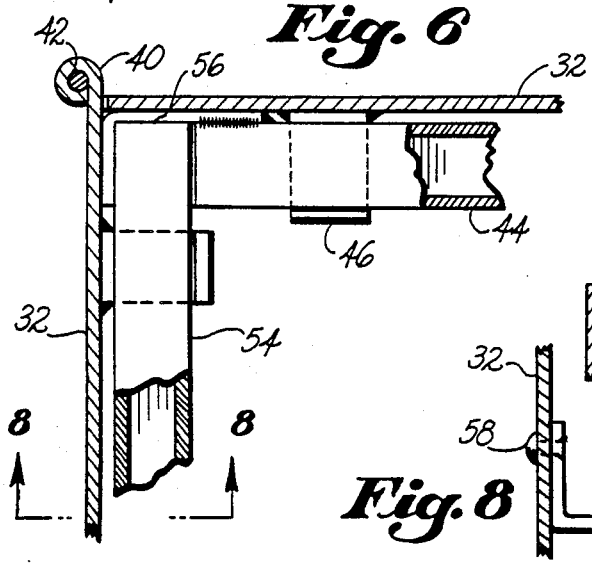
Fig. 7
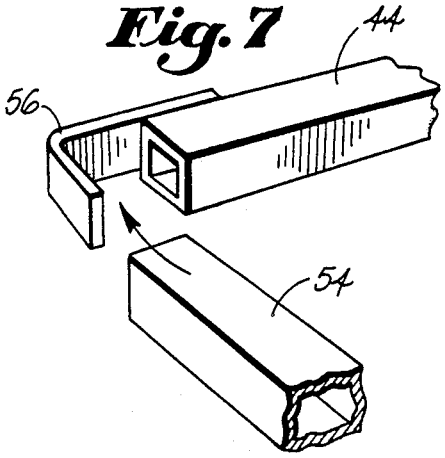
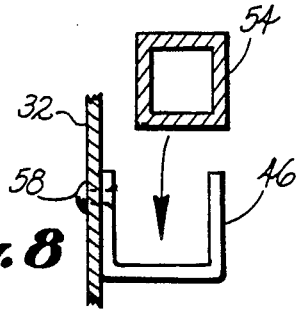
Fig. 8

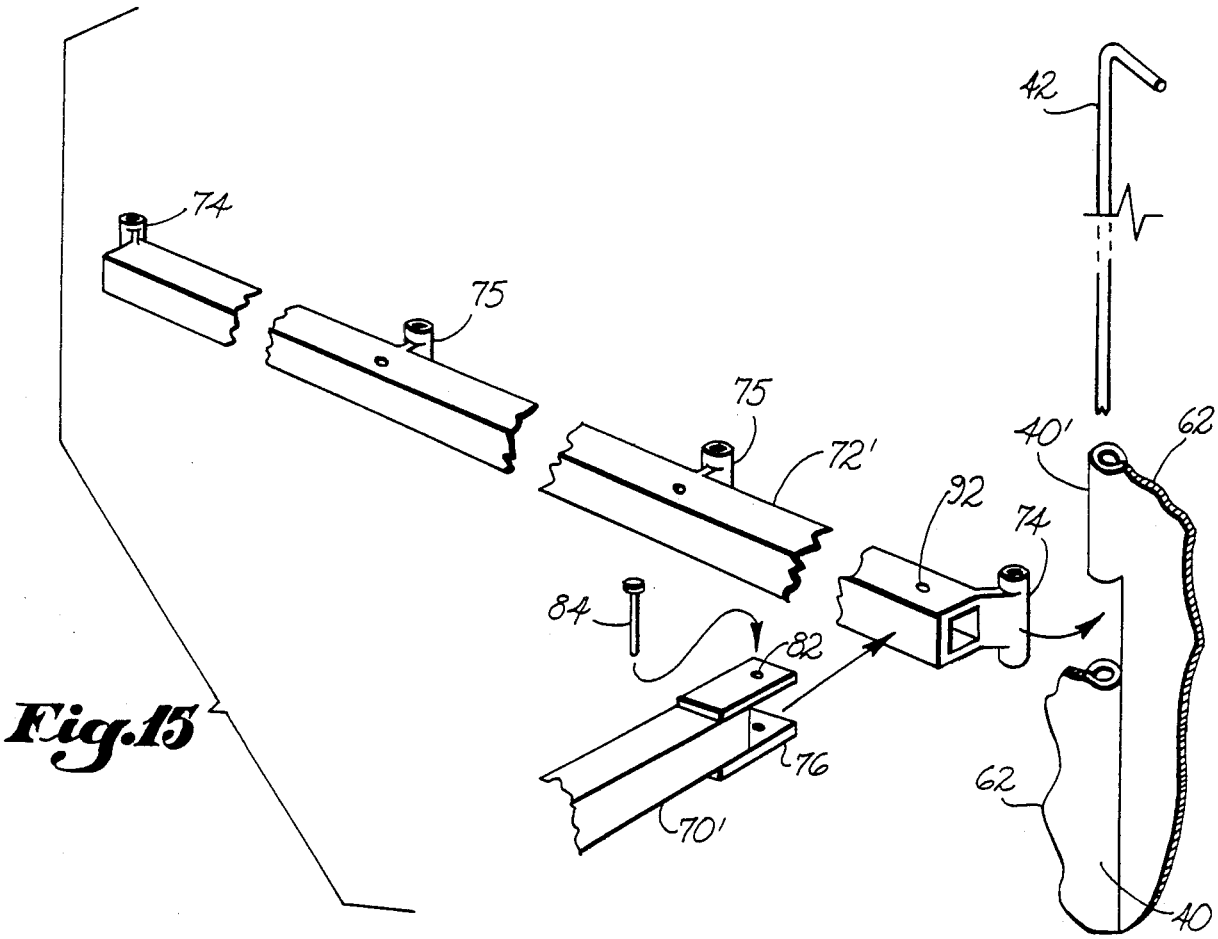
Fig. 15
Fig. 16
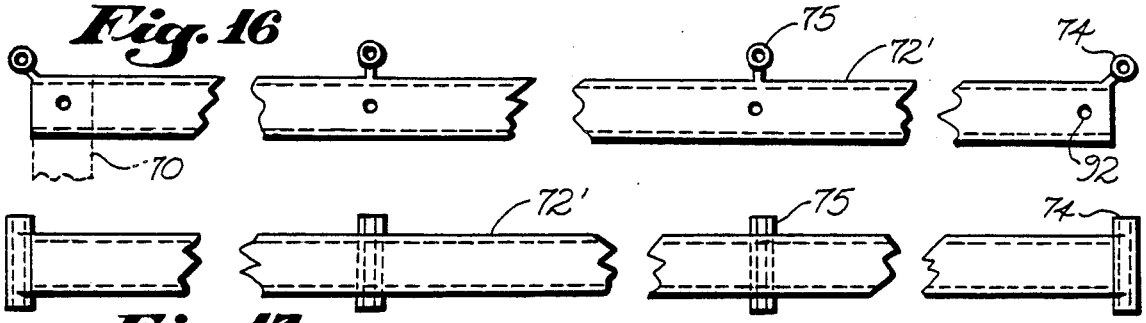
Fig. 17
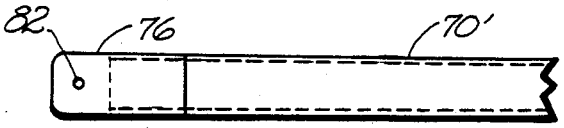
Fig. 18
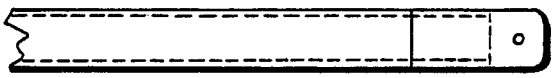
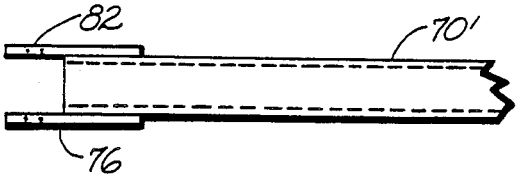
Fig. 19
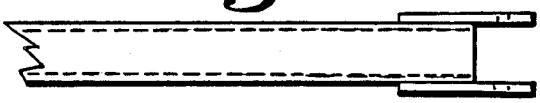

PORTABLE SAFETY TRENCH AND PIT FORM SYSTEM

BACKGROUND OF THE INVENTION

The present invention relates generally to safety enclosures for those working slightly below ground level, and more particularly to a portable safety trench and pit form system for providing safety to workers within several feet below ground level.

The safety of workers effecting construction and repair within only several feet below ground level has become a concern with respect to collapse of the unsupported dirt and gravel pit walls. Many states, by law, now require that a pit form be used for worker safety where the pit is more than four feet deep.

Prior art, in addition to disclosing on-site fabricated wooden wall retaining structures which are difficult to reuse and, at best, deteriorate rapidly due to moisture, also disclose devices which are expensive, generally difficult to assemble and time consuming to deploy, which do not provide adequate worker protection, and/or which require additional equipment for their deployment and use such as heavy hoisting equipment or the like.

Such prior art devices with one or more of the above inadequacies are disclosed in the following U.S. Pat. Nos. 4,220,423, 840,747, 4,310,267, 3,969,852, 4,090,365, and 4,188,159.

The present invention provides a portable, lightweight pit and trench form system which includes easy to handle components and is readily assembleable by one or two workers within the excavation. The system is adapted for various size excavations and also provides work access openings through at least one side of the safety enclosure. This invention is economical to fabricate and reuseable virtually indefinitely.

BRIEF SUMMARY OF THE INVENTION

The present invention is directed to a multi-sided portable trench and pit form system having at least two panels forming each side, each panel releasably interconnectable along the vertical margins of each adjacent panel and side. Elongated rigid braces are also provided which releasably interconnect to and against the sides and spanning the interconnected panels to rigidize the sides. Additionally, the elongated braces also interconnect at their ends to rigidize the preselected relative angular positioning of the sides one to another. The entire assembly forms a perimeter wall within which a worker may safely function when working below ground level. An opening may be provided in one panel or between adjacent panels forming a side and having a slideable closure panel to provide working access outside of the enclosure.

It is therefore an object of this invention to provide a portable trench and pit form system which includes modular components which may be utilized to assemble a safety enclosure or barrier wall for workers in small excavations.

It is another object to provide the above invention which is readily deployable and disassembleable by one or two workers.

It is another object to provide the above invention which is lightweight, economical to fabricate, easy to store, and reusable.

It is another object to provide the above invention which is adaptable to various size excavations.

It is another object to provide the above invention which does not require the use of heavy equipment in its deployment.

In accordance with these and other objects which will become apparent hereinafter, the instant invention will now be described with reference to the accompanying drawings in which:

BRIEF DESCRIPTION OF THE DRAWINGS

FIG. 1 is a perspective view of the invention shown fully assembled and in place within a partial excavation.

FIG. 2 is a cross section view in the direction of arrows 2—2 in FIG. 1.

FIG. 3 is a side elevation view of one embodiment of one of the panels of the invention.

FIG. 4 is a side elevation view of another embodiment of one of the panels of the invention.

FIG. 5 is a broken perspective view of the embodiment of the invention shown in FIG. 1 in exploded form showing details for assembly thereof.

FIG. 6 is an enlarged cross sectional view in the direction of arrows 6—6 in FIG. 5.

FIG. 7 is a perspective view of the detail shown in FIG. 6.

FIG. 8 is a cross section view in the direction of arrows 8—8 in FIG. 6.

FIG. 15 is a broken perspective view showing details for assembly of a portion of yet another embodiment of the invention.

FIG. 16 is a top plan view of the side panel brace shown in FIG. 15.

FIG. 17 is a side elevation view of the side panel brace shown in FIG. 15.

FIG. 18 is a top plan view of the end panel brace shown in FIG. 15.

FIG. 19 is a side elevation view of the end panel brace shown in FIG. 15.

DETAILED DESCRIPTION OF THE INVENTION

Figure 9:
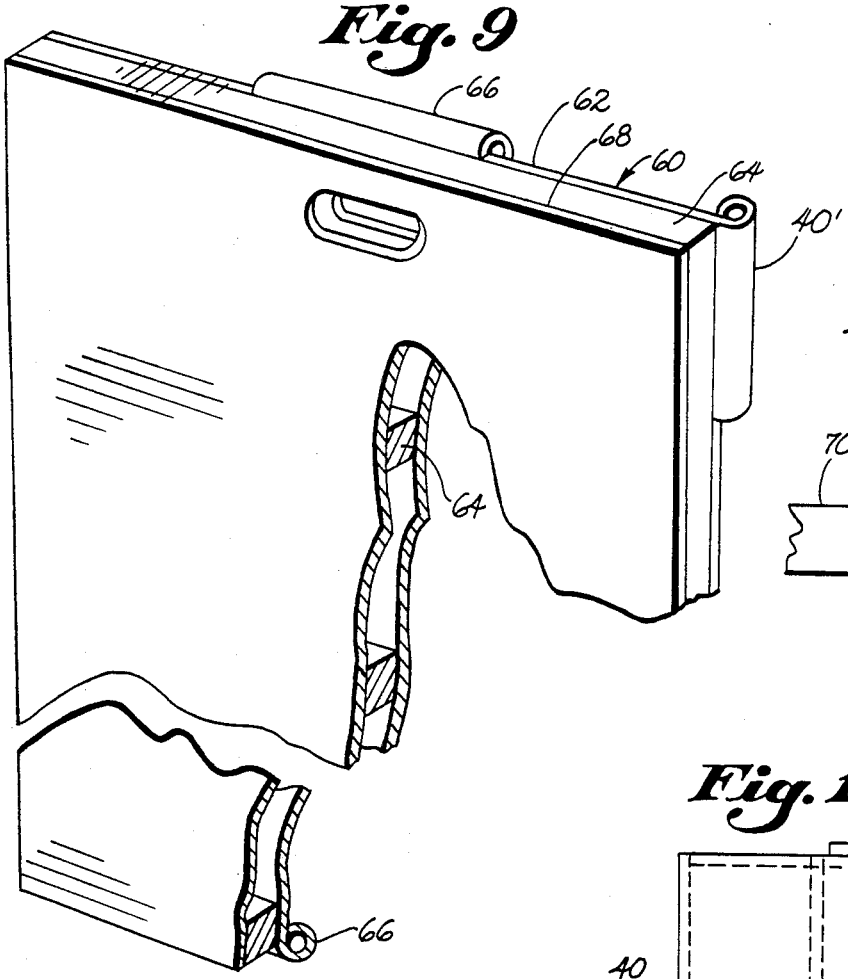
FIG. 9 is a broken perspective view of another embodiment of one of the panels having a double wall construction.

Referring now to the drawings, and particularly to FIGS. 1-4, one embodiment of the invention is shown generally at 30 and include three pairs of panels 32 which combine to form three sides of the assembly 30. The fourth side comprises panels 36 and 38 which are adapted to provide worker access from within the assembly to the outside of the enclosure via a slideable door 48 held by guides 50 and 52. The individual panels 32 and 36 and 38 are releasably held together by elongated hinge pins 42. The entire sides of this assembly are, likewise, releasably retained together by hinge pins 42 at the corners of the assembly 30 in a manner to be described herebelow.

Referring additionally now to FIGS. 5–8, the assembly and interrelationship of the components is there depicted. Panels 32 include panel tubes 40 rigidly connected in spaced alternating fashion as shown along the vertical side margins of each panel 32, as well as panels 36 and 38 as earlier depicted in FIGS. 1–4. By the offset opposing arrangement of these panel tubes 40 along opposite vertical margins of the panels 32, 36, and 38, when two such panels 32 and mating panels 36 and 38 are positioned adjacent one another and in alignment one to another to form a side, elongated hinge pin 42 may be inserted through the common aperture provided through the axially aligned panel tubes 40. After at least two sides of the assembly, including either pairs of panels 32 or panels 36 and 38 are interconnectable by this means, elongated brace bars 44 and 54 may then be installed into brackets 46 provided rigidly attached to the panels 32, 36, and 38.

The manner in which these elongated braces 44 and 54 are supportably received into brackets 46 is best seen in FIG. 5. These braces 44 and 54 are adapted in length to substantially span the entire width of each side comprising pairs of panels 32 and opposing panels 36 and 38. These installed braces 44 and 54 serve to rigidize and stablize the entire side into a rigid plane during use to resist pressures of falling dirt, protecting the worker within. FIG. 8 typically depicts the installation of brace 54 being installed into bracket 46.

In addition to providing stability for each side, the braces 44 and 54 are adapted as best seen in FIGS. 6 and 7 to interengage one to another at the ends of each brace so as to establish and rigidize the angular orientation of adjacent sides at the corners of the assembly 30. FIG. 7 best depicts this assembly installation whereby bracket 56 integral with brace 44 supportively receives the end of brace 54 therein.

Figure 11:
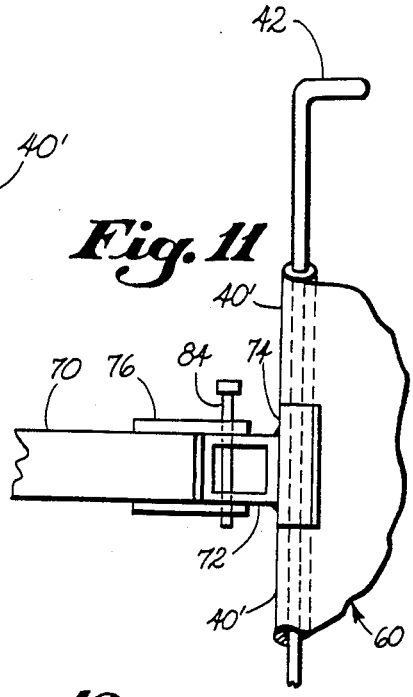
FIG. 11 is an enlarged side elevation view of FIG. 10 in assembled form.
Figure 10:
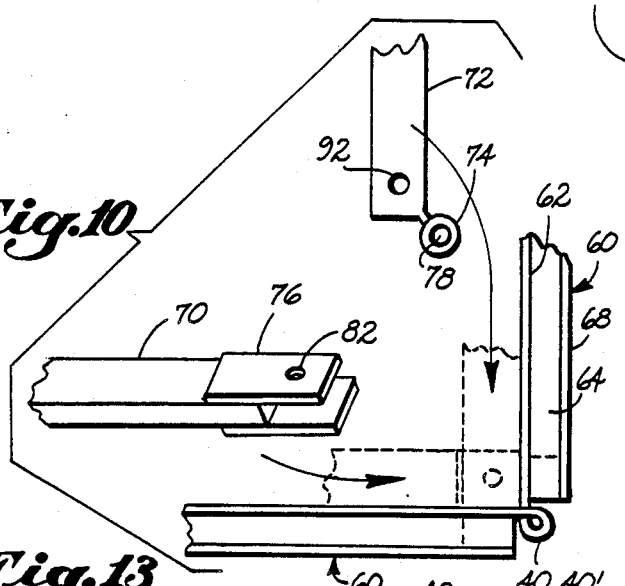
FIG. 10 is an enlarged perspective view of details for assembly of the embodiment of the invention including the panel shown in FIG. 9.

Referring now to FIGS. 9, 10, and 11, another embodiment of a part of a panel, a panel portion 60 comprising one element of an entire panel, is shown. This panel portion 60 is of a sandwich or dual layered construction for weight reduction wherein separate panel sheets 62 and 68 are interconnected by grid 64 attached therebetween forming alternate hollow portions for reduced weight and increased strength by the lateral displacement of the panel sheets 62 and 68.

In addition to having shortened panel tubes 40′, panel portion 60 also includes panel tubes 66 along the top and bottom horizontal margins of each panel portion 60, again in opposing alternate alignment top margin to bottom margin as best seen in FIG. 9. By this arrangement, each panel portion 60 may, in addition to being utilized to expand the width or horizontal dimension of each side, may also be releasably pinned to additional panel portions 60 placed in the upwardly direction to increase the usable height of this assembly.

Also shown in FIGS. 10 and 11 is another embodiment of matching brace pairs 70 and 72. The distal ends of brace 70 include clevis 76, while the distal ends of brace 72 include diagonally disposed transverse brace tubes 74 having aperture 78 therethrough. Additionally, panel tubes 40′ along one vertical panel margin have been foreshortened an amount equal to the length of brace tube 74. By this means, then, brace 72 may be axially aligned and pinned together with panel portion 60, while brace 70 may be pin connected through aperture 82 to brace 72 through coaligned apertures 82 and 92 by pin 84 as best seen in FIG. 10 and 11.

Figure 12:
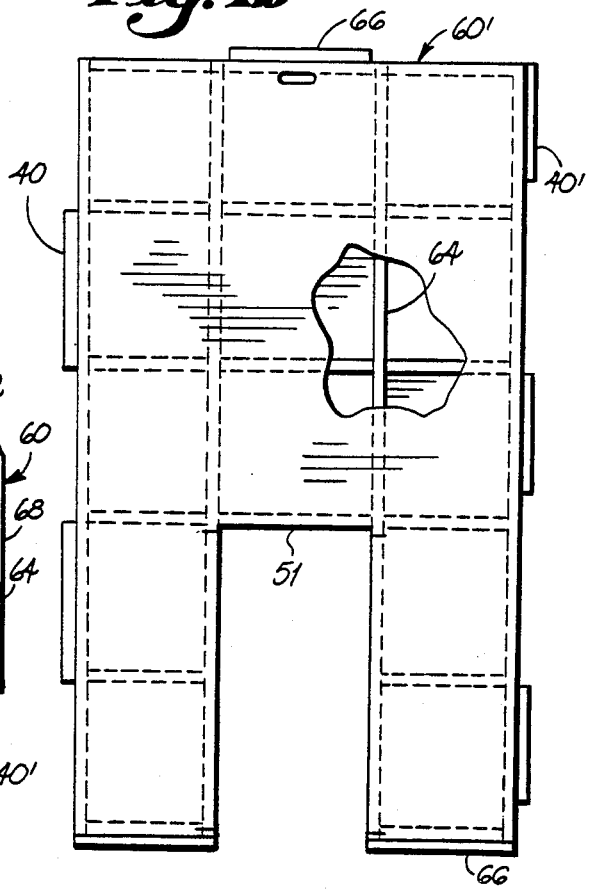
FIG. 12 is a side elevation view of another embodiment of one of the panels having a double wall construction.
Figure 13:
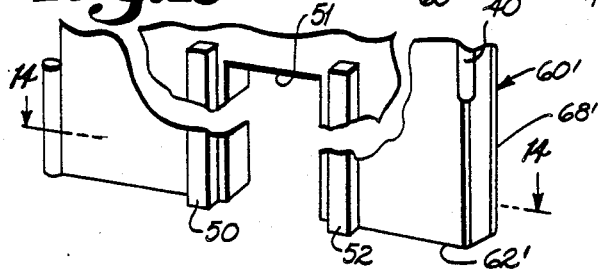
FIG. 13 is a broken perspective view of the lower portion of FIG. 12.
Figure 14:
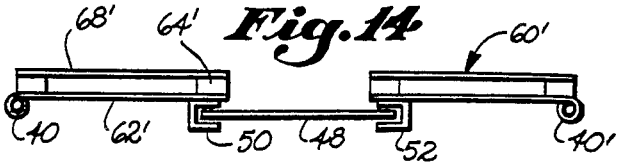
FIG. 14 is a section view in the direction of arrows 14—14 in FIG. 13.

Referring now to FIGS. 12, 13 and 14, another embodiment of the panel portion is shown at 60′ and, in addition to including panel tubes 66 along the horizontal margins for providing the upward height modularity which may be required in certain situations, panel portions 60′ also includes work access opening 51 which may be opened or closed via slidable door panel 48 held within guides 50 and 52 attached to panel portion 60′. This embodiment also includes separated panel sheets 62′ and 68′ rigidly interconnected by grid 64 therebetween as previously described for increased strength and reduced weight.

Referring now to FIGS. 15 through 18, another embodiment of the invention is shown having braces 70′ and 72′ in conjunction with panels 62. Braces 70′ and 72′ have the clevis—76 and end brace tube—70 interengagement arrangement with shortened panel tubes 40′ as previously described which are all coaxially alignable and releasably connectable by elongated hinge pin 42. However, additionally, braces 72′ and 74′ also include intermediate brace tubes 75 which are transversely aligned and disposed along the length of brace 72′ as best seen in FIG. 16 and 17. These intermediate brace tubes 75 are spaced and adaptively positioned along the length of brace 72′ to match the spacing between tubes 40′ along each vertical margin of panel 62. By this arrangement, then, panels 62 are interconnectable between one end brace tube 74 and the next adjacent intermediate brace tube 75 and between adjacent intermediate brace tubes 75 accordingly. Thus, by the sizing of the length of brace 72′ and the positioning of intermediate brace tubes 75, a plurality of panels 62 may be rigidized by this pin interconnection means with the vertical panel tubes 40′ as previously described.

Although brace 70′ as shown in FIG. 18 and 19 does not include intermediate brace tube 75 because this embodiment is shown intended to span only one panel of the side, such intermediate tubes as at 75 may be added where required.

In general, then, the invention as hereabove described invisions a modular system of adaptive panels, braces, door panel closures, and elongated hinge pins adaptively sized and provided in such quantities as may be required to construct virtually any size width and height multi-sided pit and form system for protecting workers while working slightly beneath ground level. The assembly may include two, three, four or more sides and may form a closed wall perimeter or may be open sided as against a hill or mound. However, the preferred embodiment invisions a closed perimeter of, preferrably four sides to protect workers in an excavation into flat ground.

While the instant invention has been shown and described herein in what is conceived the most practical and preferred embodiment, it is recognized that departures may be made therefrom within the scope of the invention, which is therefore not to be limited to the details disclosed herein, but is to be accorded the full scope of the claims so as to embrace any and all equivalent apparatus and articles.

What is claimed is:

1. A multi-sided portable trench and pit form system comprising:

at least two panels forming each said side;

releasable interconnecting means for pivotally interconnecting the vertical margins of each adjacent said panel and side;

elongated brace means releasably interconnectable against each said side for rigidizing each said pivotal interconnecting means;

said brace means includes a plurality of rigid brace bars, the ends of each said brace bar mateably interengaging the end of the next adjacent said brace bar at the intersection between adjacent said sides for rigidizing the angular orientation between said adjacent sides.

2. A multi-sided portable trench and pit form system as set forth in claim 1, wherein said releasable interconnecting means includes:

a plurality of opposing and alternately spaced panel tubes connected along each said vertical panel margin;

said panel tubes positioned and adapted for mating alignment and registry along a first common axis between adjacent said panels of each said side;

an elongated hinge pin for insertion through said aligned panel tubes along said first common axis.

3. A multi-sided portable trench and pit form system as set forth in claim 2, wherein said brace means includes:

a plurality of elongated rigid brace bars supportively receivable into a plurality of brace support brackets connected to the surface of each said panel;

said brace bar sized and adapted to span substantially the entire width of each said side.

4. A multi-sided portable trench and pit form system as set forth in claim 2, wherein said brace means includes:

a plurality of elongated rigid brace bars having at least one integral transverse brace tube positioned along the length of said brace bars;

said brace bars sized and adapted to span substantially the entire width of each said side;

said brace tube and said panel tubes positioned and adapted for mating alignment and registry along a second common axis between adjacent said panels of each said side for insertion of one said elongated hinge pin therethrough;

brace bar end fastening means connected at the ends of said brace bar for mateable interconnection with said panel tubes along said first common axis.

5. A multi-sided portable trench and pit form system as set forth in claim 2, further comprising:

an opening in one said side;

a closure panel slideably engageable over said opening;

said opening for work area access outside said system.

6. A multi-sided portable trench and pit form system as set forth in claim 1, wherein said panels also include:

two spaced apart sheets of material separated by, and connected to, a grid therebetween.

7. A multi-sided portable trench and pit form system as set forth in claim 1, wherein said panels are formed of sheet aluminum.

8. A multi-sided portable trench and pit form assembly as set forth in claim 1, further comprising:

second releasable interconnecting means for pivotally interconnecting the horizontal margins of each vertically adjacent said panel and side.

* * * * *